US008177235B1

(12) United States Patent
Lemberg et al.

(10) Patent No.: US 8,177,235 B1
(45) Date of Patent: May 15, 2012

(54) BONUS GAME INVOLVING CARD RANGE WAGERING

(76) Inventors: Joseph E. Lemberg, Bloomfield Hills, MI (US); Steven J. Lemberg, Bloomfield Hills, MI (US)

( * ) Notice: Subject to any disclaimer, the term of this patent is extended or adjusted under 35 U.S.C. 154(b) by 0 days.

(21) Appl. No.: 12/846,564

(22) Filed: Jul. 29, 2010

Related U.S. Application Data

(63) Continuation-in-part of application No. 12/577,202, filed on Oct. 11, 2009, which is a continuation of application No. 11/558,322, filed on Nov. 9, 2006, now Pat. No. 7,669,856, which is a continuation-in-part of application No. 11/468,754, filed on Aug. 30, 2006, now abandoned.

(60) Provisional application No. 60/823,877, filed on Aug. 29, 2006, provisional application No. 60/864,793, filed on Nov. 8, 2006, provisional application No. 60/805,091, filed on Jun. 19, 2006.

(51) Int. Cl.
*A63F 3/06* (2006.01)

(52) U.S. Cl. ..... 273/292; 273/274; 463/13; 463/14; 463/18

(58) Field of Classification Search ..... 273/292, 273/274; 463/14, 13, 18
See application file for complete search history.

(56) References Cited

U.S. PATENT DOCUMENTS

| | | | | |
|---|---|---|---|---|
| 5,718,431 | A * | 2/1998 | Ornstein | 273/292 |
| 6,722,978 | B2 * | 4/2004 | Valenti | 463/18 |
| 7,104,544 | B2 * | 9/2006 | Reiner et al. | 273/292 |
| 2004/0217548 | A1 * | 11/2004 | Snow | 273/292 |

* cited by examiner

*Primary Examiner* — Gene Kim
*Assistant Examiner* — Michael Dennis
(74) *Attorney, Agent, or Firm* — Muskin & Cusick LLC

(57) ABSTRACT

A method, apparatus, and computer readable storage to implement a bonus parlay wager for a wagering game with a bonus round. The bonus round in the wagering game is activated only based upon certain conditions. The player can earn a top payout for the bonus parlay wager by winning the bonus round in two consecutive games of the wagering game.

8 Claims, 11 Drawing Sheets

BONUS GAME INVOLVING CARD RANGE WAGERING

CROSS REFERENCE TO RELATED APPLICATIONS

This application is continuation in part of application Ser. No. 12/577,202 filed Oct. 11, 2009, which is a continuation of U.S. application Ser. No. 11/558,322 filed Nov. 9, 2006, now issued U.S. Pat. No. 7,669,856, which itself: 1) claims benefit to provisional application 60/823,877, filed Aug. 29, 2006, 2) claims benefit to provisional application 60/864,793 filed Nov. 8, 2006, and 3) is a continuation in part of U.S. application Ser. No. 11/468,754 now abandoned which in turn claims benefit to provisional application 60/805,091 filed Jun. 19, 2006. All six applications (Ser. Nos. 12/577,202; 11/558,322; 60/823,877; 60/864,793; 11/468,754; 60/805,091) are incorporated by reference herein in their entireties for all purposes.

BACKGROUND OF THE INVENTION

1. Field of the Invention

The present inventive concept relates to a wagering game intended for use in casinos.

2. Description of the Related Art

Acey-Deucey (also known as "In-Between" or "Yablon") is a gambling game which involves dealing two cards face up to a player, and then dealing a third card wherein the player wins if the third card falls between the player's first two cards. Please see Scarne's Encyclopedia of Games, first edition, 1973, page 313 ("Yablon"), which is incorporated by reference herein in its entirety.

While at least one variation of Acey-Deucey appeared in casinos and for a time proved entertaining to casino players, it has been nearly extinct for many years, largely because that variation was very simple and repetitive, involved no meaningful strategy yet moved too rapidly, causing players to lose interest quickly.

Therefore, what is needed is a more interesting version of Acey-Deucey which players will find more challenging, exciting, and appropriately-paced in order to maintain long-term player interest.

SUMMARY OF THE INVENTION

It is an aspect of the present invention to provide an exciting casino wagering game.

The above aspects can be obtained by (a) providing a physical deck(s) of cards; (b) receiving a first initial wager and a bonus parlay wager from a player; conducting a first wagering game using the deck(s) of cards to a first result, the first result being from a set of possible outcomes comprising non-bonus win, loss, and bonus win; (c) resolving the first initial wager; (d) receiving a second initial wager from the player; (e) conducting a second wagering game using the deck(s) of cards to a second result, the second result being from a set of possible outcomes comprising non-bonus win, loss, and bonus win; (f) resolving the second initial wager; and (g) resolving the bonus parlay wager based upon a set of predetermined conditions, (h) wherein the set of predetermined conditions comprises if the player loses the first initial wager then the player loses the bonus parlay wager; (i) wherein the set of predetermined conditions comprises if the player receives a bonus win on the first wagering game and another bonus win on the second wagering game then the bonus parlay wager wins a first payout; (j) wherein the set of predetermined conditions comprises if the player receives a bonus win on the first wagering game and does not achieve a bonus win on the second wagering game, then the bonus parlay wager wins a second payout, the second payout being lower than the first payout.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
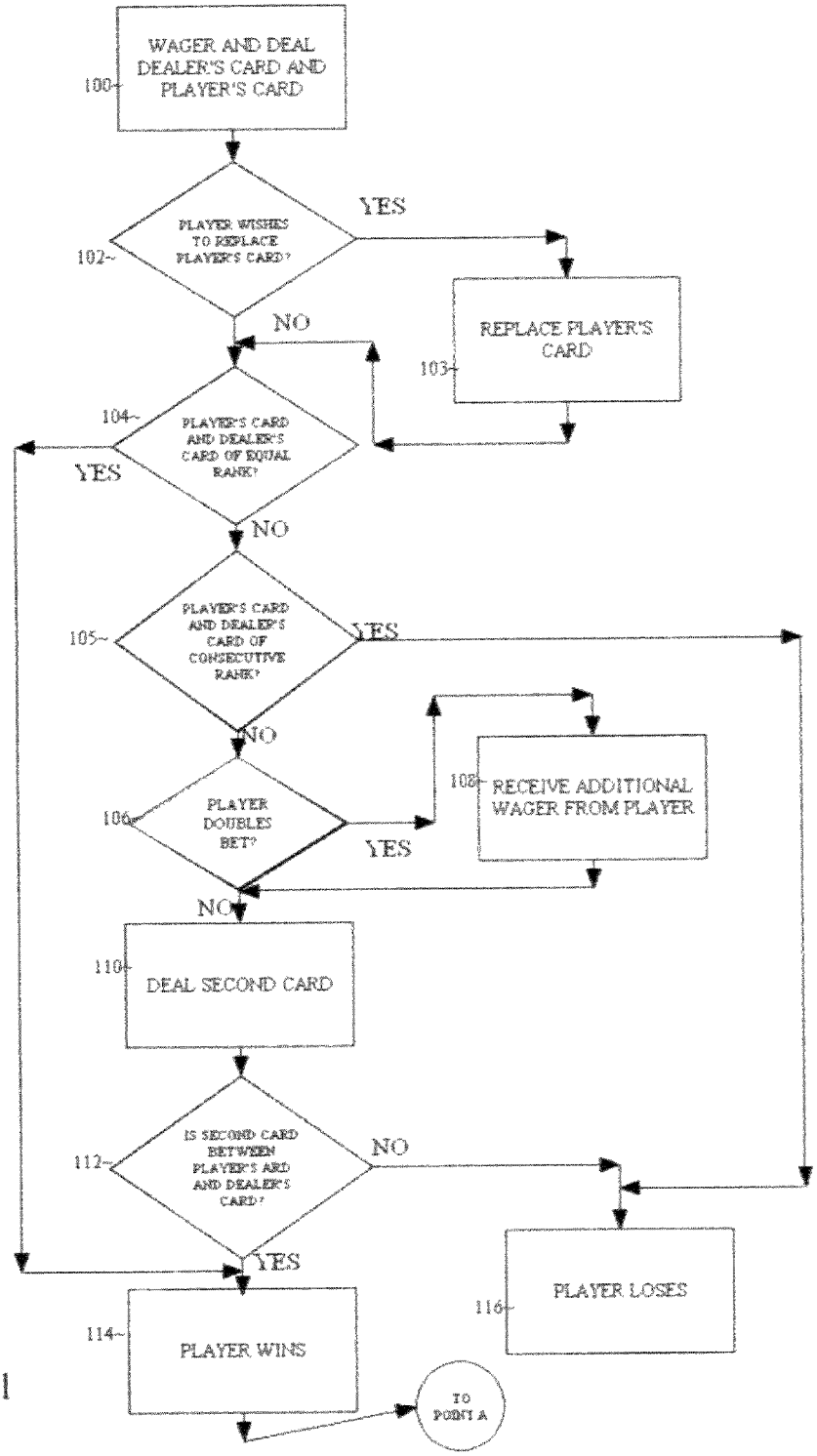
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer an exciting wagering game, wherein the player benefits when dealt cards fall between two other cards.

The game is played as follows. A player makes a wager. The player is dealt a card and the dealer is dealt a card. If the player wishes to replace his or her card, he can do so a maximum of one time. The player then has an option to double (or increase without necessarily doubling) the wager by placing a double wager. The player is dealt a second card, wherein if the second card falls between the player's card and the dealer's card, then the player wins a payout (e.g., even money) on the wager. If the player placed a double wager (he was not required to do so, but could do so at his or her option), then the player also wins a payout (e.g., even money) on the double wager as well.

The game also incorporates a bonus round, wherein a bonus card is dealt, and if the bonus card falls between the player's second card and the dealer's card, then the player wins a bonus payout. The player is not required to make a wager to play or win in the bonus payout.

FIG. 1 is a flowchart illustrating an exemplary method of implementing a wagering game, according to an embodiment.

The method can begin with operation 100, which receives a wager from the player and then deals a player's card and a dealer's card. This can be done in any order. The wager can be considered an initial wager.

From operation 100, the method can proceed to operation 102, which determines whether the player wishes to replace the player's card. For example, if the gap between the player's card and the dealer's card is small, then the player may wish to replace the player's card in order to increase the gap, and hence increase his or her chances of winning. If the player wishes to replace the player's card, then the method can proceed to operation 103, which replaces the player's card. This can be done by the player indicating (e.g., by speaking or hand signal) to the dealer that he or she wishes to replace the player's card, and the dealer can deal another card to the player which replaces the player's card dealt in operation 100. If the player does not wish to replace the player's card dealt in operation 100, then he can indicate as such and the method can proceed to operation 104.

From either operation 102 or operation 103, the method can then proceed to operation 104, which determines if the player's card and the dealer's card are of equal rank. If they are, then the method proceeds to operation 114, wherein the player wins. In this situation, the player does not qualify for the bonus round (although in an alternative embodiment if the player's card and the dealer's card are of equal rank the player would qualify for the bonus round). In an alternative embodiment, if the player's card equals the dealer's card then the player automatically loses.

If the determination in operation 104 determines that the player's card and the dealer's card are not of equal rank, then the method can proceed to operation 105, which determines whether the player's card and the dealer's card are of consecutive rank. If they are, then the method proceeds to operation 116 wherein the player loses.

If the determination in operation 105 determines that the player's card and the dealer's card are not of consecutive rank, then the method can proceed to operation 106, which determines whether the player decides whether to double his or her bet. Note that the player may (depending on the house rules) be allowed to increase his or her bet at an amount less than the wager up to an amount equal to the wager (doubling). If the player wishes to double his or her bet, then the method can proceed to operation 108, which receives an additional wager (a double wager) from the player. The player can place an additional wager by placing a double wager on the table alongside his or her wager. If the player does not wish to double his or her bet, then from operation 106 the method can proceed to operation 110.

If the player, in operation 100, has an automatically losing hand, the player is still free to replace the player's card in operation 103.

From either operation 106 or operation 108, the method can proceed to operation 110, which deals a second card.

From operation 110, the method can proceed to operation 112, which determines whether the second card falls between the player's card and the dealer's card. For example, if the player's card is a two and the dealer's card is a ten, and the second card is a seven, then the seven falls between the two and the ten. It is noted that if the player chose to replace the player's card in operation 103, then the player's card refers to the more recent player's card and not the original player's card dealt in operation 100. Typically, suits do not matter. A card (A) falls between two cards (B, C) if A has a rank greater than the lowest rank of (B, C) and A has a rank less than the highest rank of (B, C). If A equals B or C, then A does not fall between B and C. Although in an alternative embodiment, if A equals B or C, then A is considered to fall between B and C.

If the determination in operation 112 determines that the player's second card does not fall between the player's card and the dealer's card, then the method can proceed to operation 116, wherein the player loses. The player's wager, and any double wager placed, will be collected by the house.

If the determination in operation 112 determines that the second card does fall between the player's card and the dealer's card, then the player wins. The player's wager as well as his or her double wager (if made) can be paid. The method can then proceed to point B of FIG. 2, in order to implement the bonus round.

Figure 2:
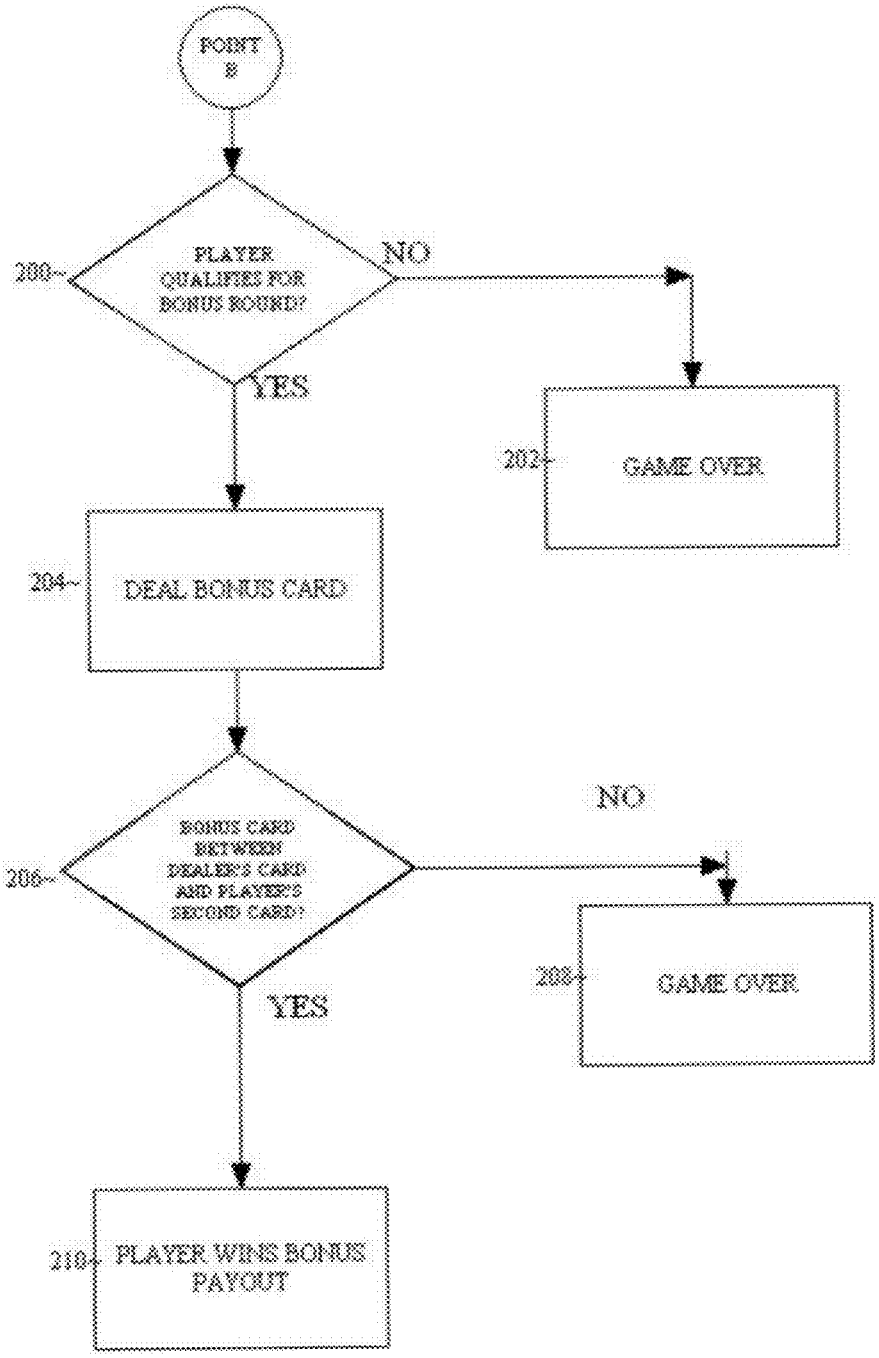
FIG. 2 is a flowchart illustrating an exemplary method of implementing a bonus payoff for a wagering game, according to an embodiment.

FIG. 2 is a flowchart illustrating an exemplary method of implementing a bonus round of a wagering game, according to an embodiment.

The bonus round can be implemented when all players at the table have completed their hands. In operation 200, it is determined whether the player qualifies for the bonus round. If the determination is that the player does not qualify for the bonus round, then the method proceeds to operation 202, wherein the game is over. The player qualifies for the bonus round, in addition to winning his or her wager, if there is at least one possible rank of card between the player's second card and the dealer's card. If the player's second card and the dealer's card are of consecutive rank, then the player does not qualify for the bonus round.

If the determination in operation 200 determines that the player qualifies for the bonus round, then the method can proceed to operation 204, which deals a bonus card. The bonus card can be a common card for the entire table.

From operation 204, the method can proceed to operation 206, which determines whether the bonus card falls between the dealer's card and the player's second card. Note that in an alternative embodiment, any two dealt cards can be used besides the dealer's card and the player's second card. For example, the player's second card and the player's card can be used, or any other two cards.

If the determination in operation 204 determines that the bonus card does not fall between the two cards (e.g., the player's second card and the dealer's card), then the method proceeds to operation 208, wherein the game is over.

If the determination in operation 206 determines that the bonus card does fall between the two cards (e.g., the player's second card and the dealer's card), then the method proceeds to operation 210 wherein the player wins a bonus payout. The payout in operation 210 is typically "free," that is, the player did not have to make an additional bet in order to win this payout.

An example of the game will now be presented in FIGS. 3B to 3E. It is noted that these figures illustrate a table that can accommodate three simultaneous players, although of course any number of players can be accommodated. In this example, two players will be playing simultaneously.

Figure 3A:
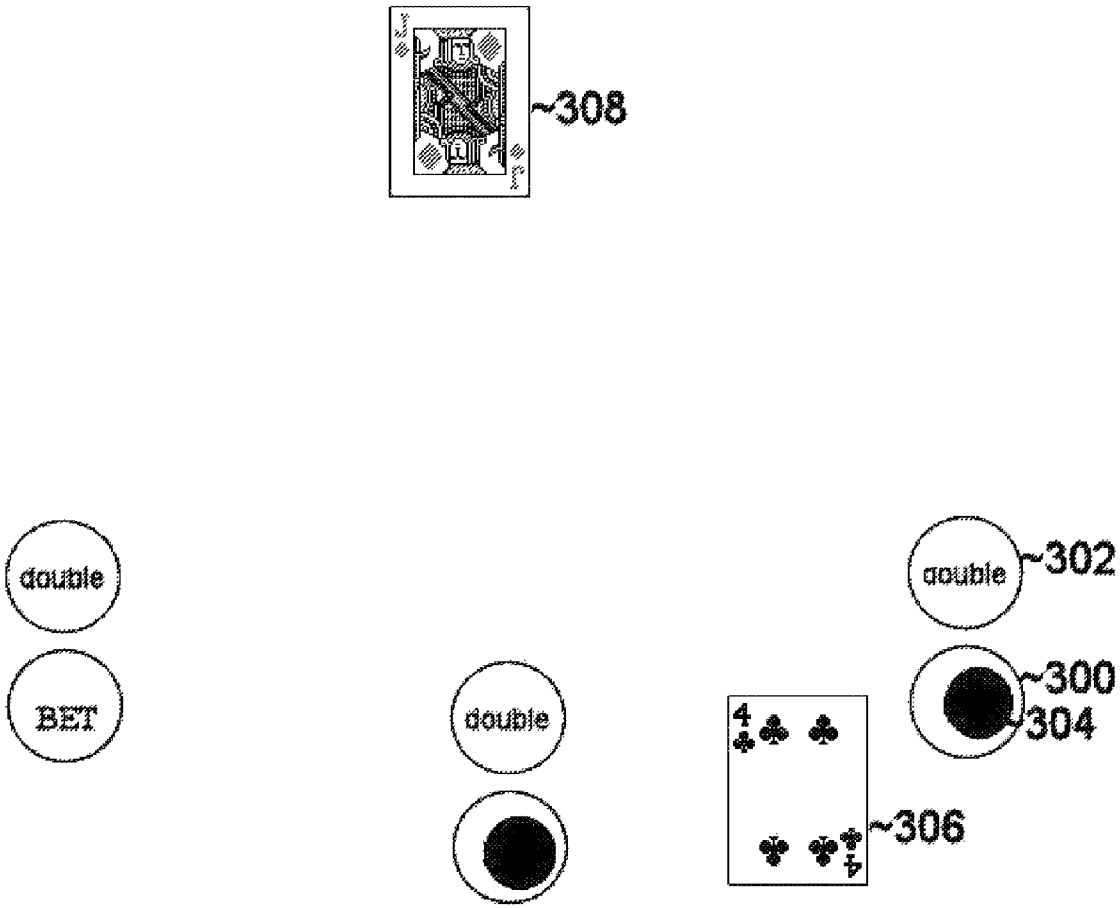
FIG. 3A is a drawing of a first stage of an example game, according to an embodiment.

FIG. 3A is a drawing of a first stage of an example game, according to an embodiment.

Player 2 (in the middle seat) and player 3 (in the right seat) are playing. Player 2 puts a $1 chip in the "bet" betting circle. Player 3 puts a $5 chip 304 in his respective "bet" betting circle 300. There is also a respective double wager betting circle 302. The dealer then deals the player his card, a four of clubs. The dealer then deals the dealer's card, a jack of diamonds. Note the cards can be dealt in any order.

Figure 3B:
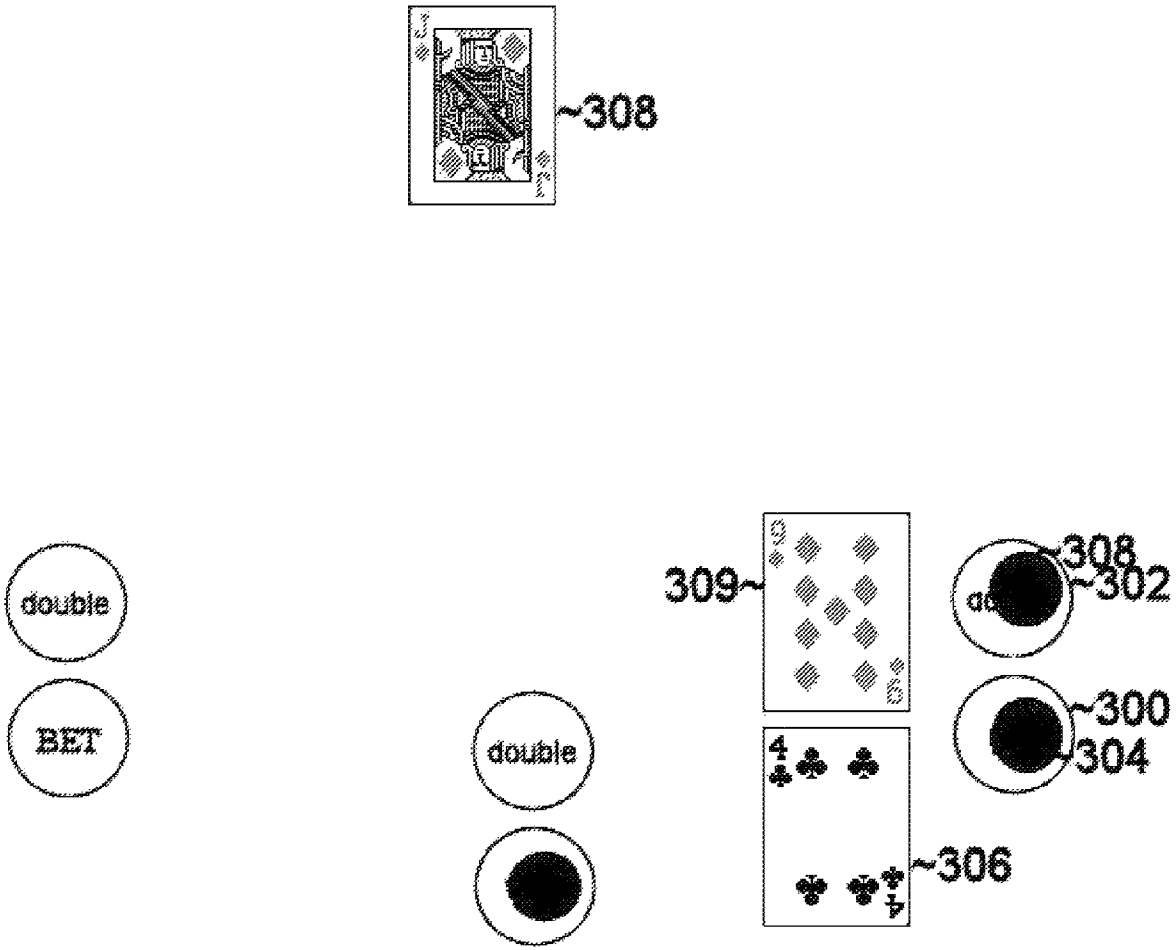
FIG. 3B is a drawing of a first stage of an example game, according to an embodiment.

FIG. 3B is a drawing of a first stage of an example game, according to an embodiment.

Player three decides to double, and places a second $5 chip 308 in the double wager betting circle. The dealer then deals a round one card 309 to player three, which is a nine of diamonds. Since the nine of diamonds falls between the four of clubs and the jack of diamonds, player 3 wins. The house will pay (not pictured) player 3 even money (although another payout can be used) on both player 3's initial wager 304 and his double wager 308. Thus, player three has won $10. The dealer can pay the player at any time (e.g., now or after the bonus card is dealt).

Figure 3C:
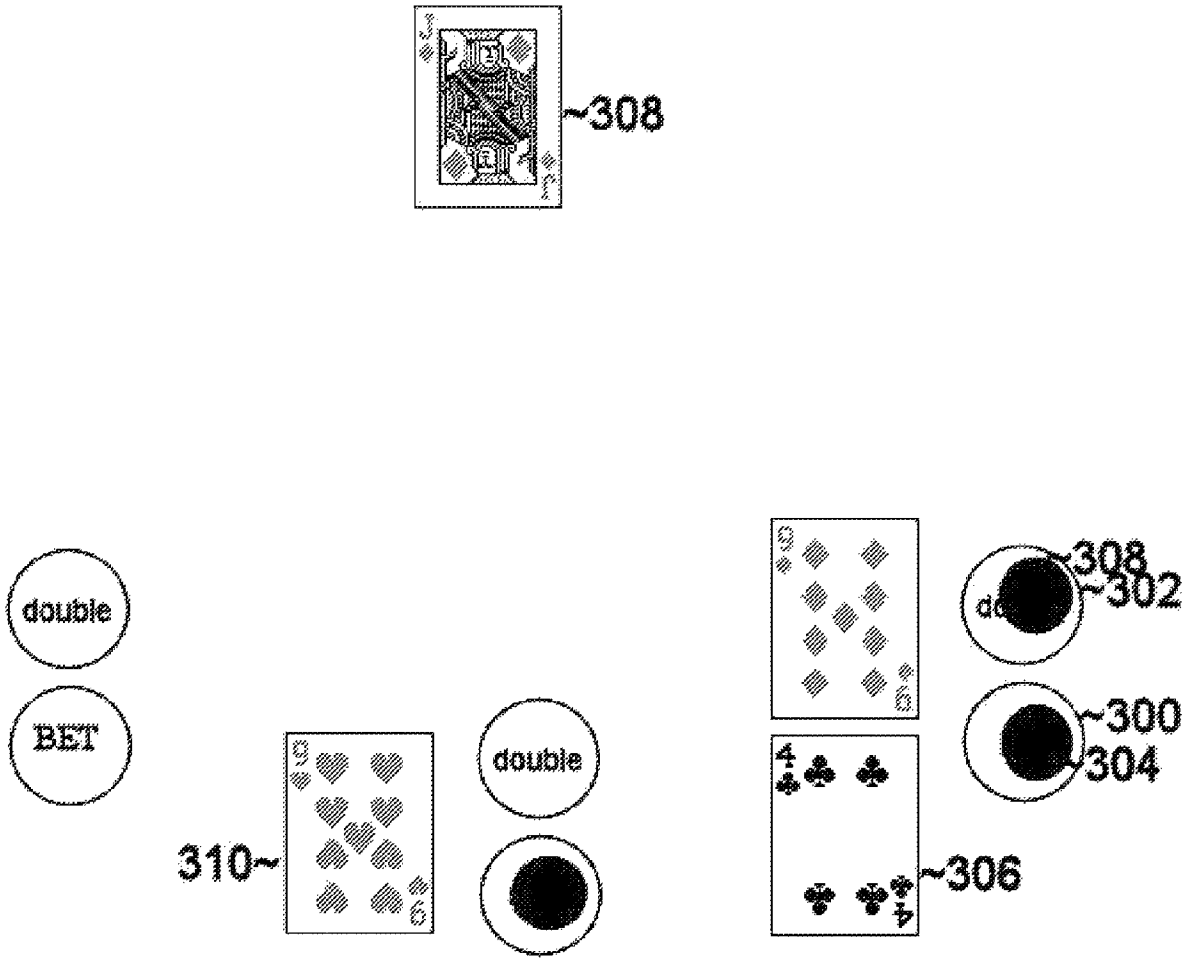
FIG. 3C is a drawing of a first stage of an example game, according to an embodiment.

FIG. 3C is a drawing of a first stage of an example game, according to an embodiment.

Now, the dealer proceeds to resolve the next player's (player two) hand. The dealer deals player 2's player's card, which is a nine of hearts.

Figure 3D:
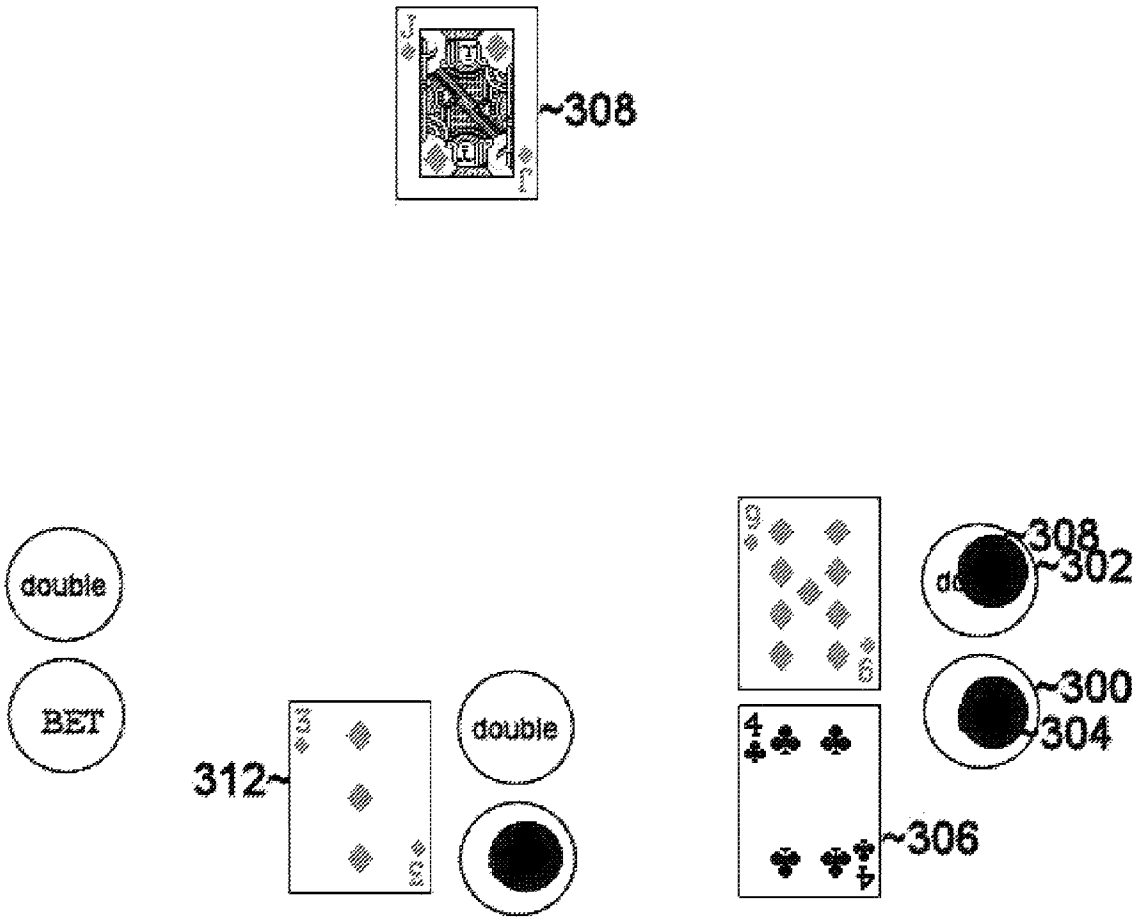
FIG. 3D is a drawing of a first stage of an example game, according to an embodiment.

FIG. 3D is a drawing of a first stage of an example game, according to an embodiment.

Figure 3E:
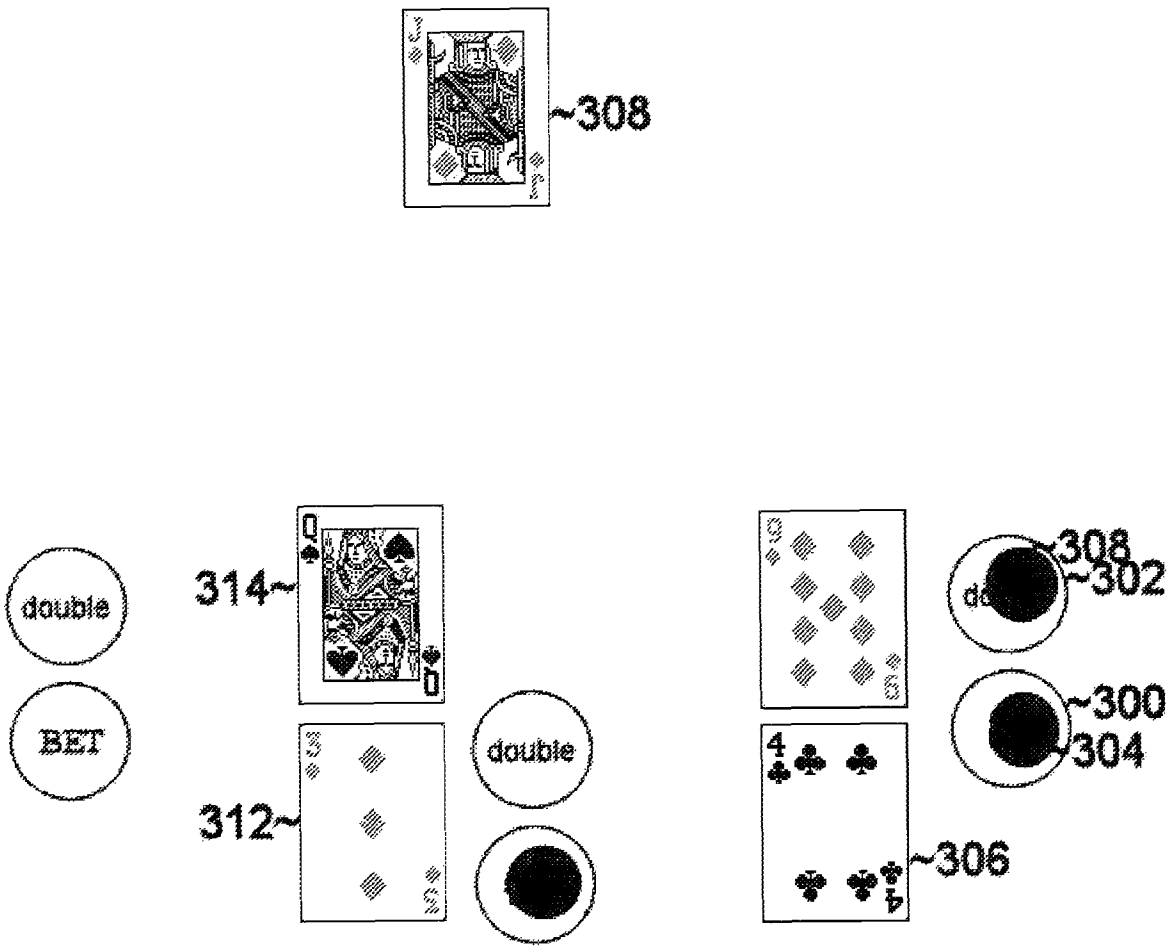
FIG. 3E is a drawing of a first stage of an example game, according to an embodiment.

Player two would not be happy with her card. This is because there is only one value (ten) that falls between a nine and a jack, which means the chances of getting a card to fall between those two cards is unlikely. So player two rightfully decides to replace player two's player's card and is now dealt a replacement player two's player's card 312, a three of diamonds. Player two does not decide to double;

FIG. 3E is a drawing of a first stage of an example game, according to an embodiment.

The dealer then deals player 2's second card 314, a queen of spades. Since the queen does not fall between the three and the jack, player two loses her wager ($1), although player two is happy that she decided not to double because had she done so, she would have lost more money.

Since all active players at the table have now finished their hands, it is time to play the bonus round. Only players who have won their wagers are eligible for the bonus round. In an alternative embodiment, players who have lost (or tied) their wagers can be eligible for the bonus round as well.

Figure 3F:
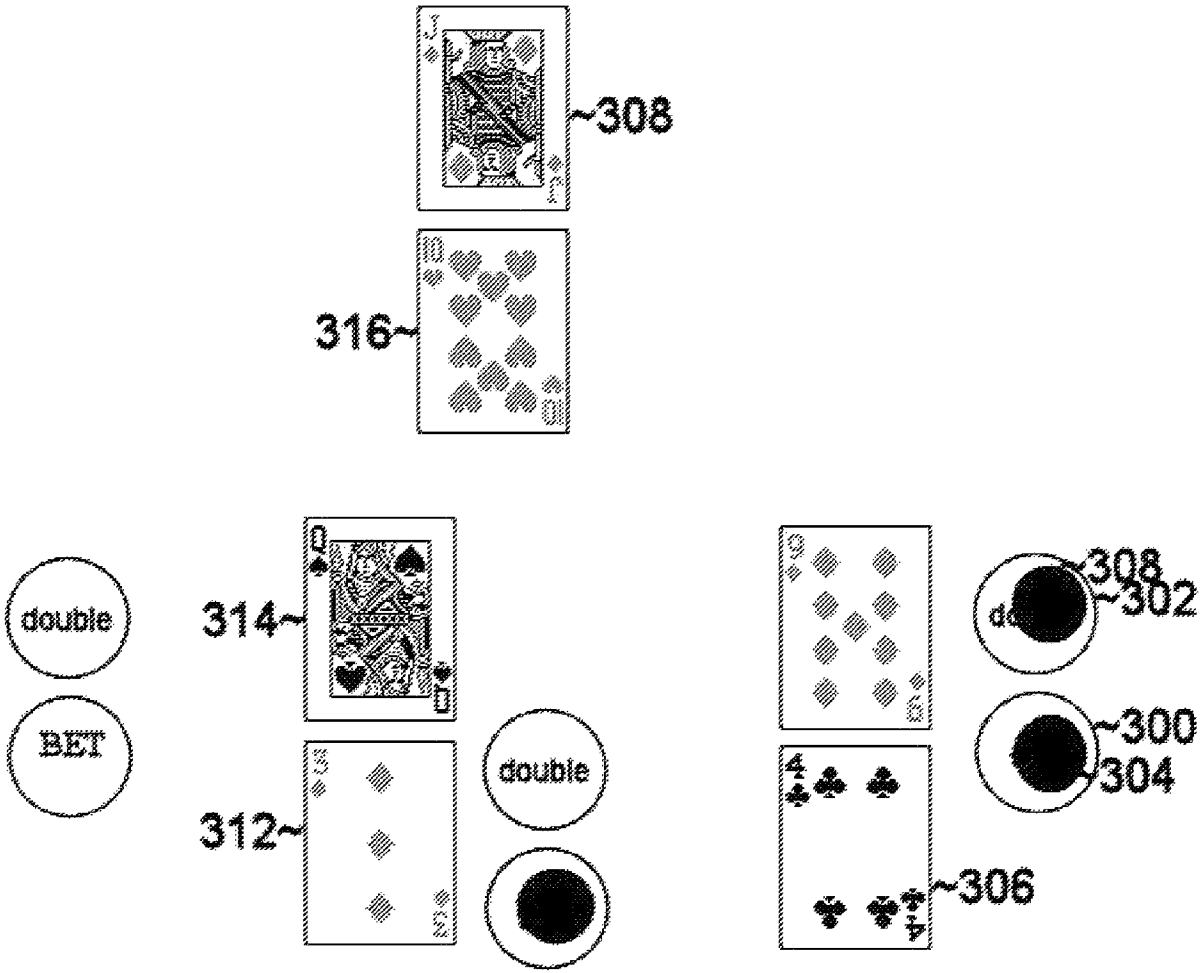
FIG. 3F is a drawing of a first stage of an example game, according to an embodiment.

FIG. 3F is a drawing of a first stage of an example game, according to an embodiment.

The dealer deals a bonus card, which can be a community card (e.g., this card applies to all live players in the bonus round). The bonus card 316 is a ten of hearts. Since the ten falls between the player 3's second card 308 (nine of diamonds) and the dealer's card (jack of diamonds), player 3 wins the bonus round. Player 3 can win a bonus payout, such as additional 1 to 2 on the wager ($2.50), and an additional 1 to 2 on the double, or 3 to 2 overall on her wager. Thus, player 3 has now won $15.00 from the current game and this game is now fully completed. In this embodiment, since player 2 lost her wager she is not eligible for the bonus round.

Of course, the order of operations illustrated in FIGS. 3A to 3F is exemplary, and the cards can be dealt in other orders/manners as well. Table I below illustrates two sample paytables that can be used with methods described herein. For these payouts, if the player's card equals the dealer's card, the player automatically wins ("Winning Pair").

TABLE I

| Event | paytable 1 | paytable 2 |
|---|---|---|
| Winning Hand | even money | even money |
| Winning Pair | 1:2 | 1:2 |
| Win With Bonus | 3:2 | 8:5 |

Thus, for example, on both paytables, the wager and the double wager pay even money. If the player gets a winning pair (e.g. both the player's card and the dealer's card have the same rank, for example, both cards are a three) then both paytables pay 1:2. On paytable 1, if the player wins the bonus round (e.g., the bonus card falls between the player's second card and the dealer's card), then this pays 3:2 of the wager, while on paytable 2, this pays 8:5 of the wager.

There are a number of other possible variations or features that may be employed in this game. These may be employed separately or in conjunction with one another. Some of these may be employed in addition to the game as described, or instead of certain elements of the game as described. Following are these variations or features:

The bonus round can be converted from a risk-free proposition (as described above) to one where each player qualifying has the option of playing or not playing the bonus round, and where those players playing the bonus round will risk some or all of their bet and initial win if they lose the Bonus Round.

In a further embodiment, players could be allowed to place an additional wager in the bonus round before they see the bonus card.

In a further embodiment, additional rounds beyond the single bonus round can be implemented. This could be accomplished by allowing successive additional rounds (e.g. bonus round I, bonus round II, bonus round III, etc.) where to win the each additional round that round's card would need to be of a rank between the player's second card and the immediately prior dealer card (e.g. bonus card, then bonus card II, then bonus card III, etc.).

In a further embodiment, a separate bonus card can be dealt to each player instead of using a common community bonus card.

In a further variation, a progressive jackpot could also be adapted to the present wagering game if desired. One possible manner to effectuate a progressive jackpot would be through the use of additional Bonus Rounds as described above. The use of a progressive jackpot could be effectuated in other alternative ways. A progressive bet could be placed along with the initial wager which feeds a progressive jackpot meter, and certain hands could allow the player to win the progressive (e.g., the player's first and second cards are an ace and the dealer's card is an ace).

In a further embodiment, when a dealer card and a player card of equal rank, this can be handled differently than as illustrated in FIG. 1. For example, instead of it being a winning hand when the dealer card and the player's first card are of equal rank, when the dealer card and the player's first card are of equal rank the hand continues with the player automatically receiving a new player's first card in place of the player's first card of equal rank to the dealer card.

Alternatively, when the dealer's card and the player's first card are of equal rank, this can result in a push on the initial wager (and optionally any double wager placed as well).

Alternatively, when the dealer's card and the player's first card are of equal rank, the player is dealt a second card and if that second card is equal in rank to both the dealer's card and the player's card, then the player wins an amount in excess of a normal winning hand (e.g., double).

In yet additional embodiments, when the dealer's card and the player's first card are of successive rank, instead of this being an automatic loser for the player, this can result in a push on the initial wager (and optionally any double wager placed as well).

In a further embodiment, when the dealer's card and the player's first card are of successive rank, then the player can automatically replace his or her card.

In further embodiments, an ace can be played as high (higher than all other ranks), low (lower than all other rank), or can be played as both (at either the player's choice or the dealer's choice).

In yet more embodiments, additional payoffs can be implemented. For example, if certain poker hands are formed from some combination comprising any combination of the player's first card and/or the player's second card and/or the dealer's card and/or the bonus card. For example, a flush, straight, three of a kind, etc., can be paid according to a paytable. Optionally, payoffs for the game can be increased for certain winning hand containing cards of the same suit.

In yet a further embodiment, side bets can be permitted, such as for poker hands (e.g., pairs, straights, flushes, three of a kind, straight flushes, etc.), as determined by some combination of the player's first card and/or the player's second card and/or the dealer's card and/or the bonus card.

In a further additional embodiment, the player's second card can be a common (community card) used by all players. In this embodiment, then all eligible players will win or lose the final round together as the second card, bonus card, and the dealer card, will all be common cards.

Moreover, the game can be played with special decks which can include jokers or other wilds cards where the wild cards can be afforded a rank as chosen by the player.

Additionally, players could be permitted to play multiple hands on each deal, and such multiple hands could produce certain winning situations that are either determined independent of the other hands or in conjunction with the other hands.

In yet another embodiment, instead of the player doubling his bet in operation 106, the player can more than double his bet (e.g., triple his or her bet).

In yet a further embodiment, the game can be played without the bonus round. It is further noted that the game (any variation described herein) can be implemented by an electronic gaming machine (EGM). It can also be played with multiple hands, for example, a player can play five hands simultaneously at one coin (or other amount) bet on each hand. With multiple hands being played there can be a common second card applying to all five (or any number) of hands, or each hand can get a separate second card. The slot machine/electronic device can have payoffs or bonus payoffs based on the number of wins and the number of bonus wins. For example, if playing five coins, the best outcome would be five bonus wins, and there could be lesser payoffs for fewer bonus wins. The slot machine/electronic version could include suited payoffs, straight payoffs and other poker hand payoffs. There could be a progressive jackpot based, for example, on winning all five hands with bonus, or possibly with some other requirements.

In a further embodiment, an additional wager can be optionally placed by the player that complements the methods described above. The player can choose to make the initial wager (in operation 100) and/or a bonus parlay bet (or bonus parlay wager). The bonus parlay bet can be resolved using a paytable such as that illustrated in Table II. "Regular win" refers to winning without winning the bonus round (operations 202 and 208; qualifying for the bonus round is not relevant, thus either the player did not qualify for the bonus round or did qualify and lost the bonus round). "Bonus win" refers to both qualifying for the bonus round for that leg and winning the bonus round for that leg (operation 210). If the player places the bonus bet (or bonus wager or bonus parlay wager), then that game is considered the first leg, and the subsequent game is considered the second leg. When the player makes the bonus parlay wager (in operation 100) and the bonus parlay wager is live after the first leg (the player gets a bonus win on the first leg), then the bonus parlay wager the player made is moved (typically by the dealer) to a different betting circle (for the same player) which indicates that the bonus parlay wager is now contingent upon the outcome of the second leg. After the second leg, the bonus parlay wager can be resolved (based on the outcome of the second leg and Table II). When the player makes a first bonus parlay wager and achieves at least a bonus win on the first leg, when the first bonus parlay wager is moved to the different betting circle a second bonus parlay wager can be made for the new game about to be played (which can be considered both the first leg for the second bonus parlay wager and the second leg for the first bonus parlay wager that was just moved). The game applied to Table II can be any of the methods described herein.

TABLE II

| $1^{st}$ leg outcome | $2^{nd}$ leg outcome | pay table 1 | pay table 2 |
|---|---|---|---|
| Bonus win | bonus win | 30:1 | 25:1 |
| Bonus win | regular win (no pair) | 10:1 | 10:1 |
| Bonus win | regular win with pair | 5:1 | 5:1 |
| Bonus win | lose | 3:1 | 3:1 |
| Regular win | n/a | push | push |
| Lose | n/a | lose | lose |

Thus, for example, if the player places the bonus parlay wager (or bonus parlay wager) and loses, the player has lost the bonus parlay wager. If the player places the bonus parlay wager and wins the game (but does not qualify for the bonus round or loses the bonus round—a "regular win") then the player pushes the bonus parlay wager (it is not taken and not paid). If the player places the bonus parlay wager and wins the game and also wins the bonus round (a "bonus win") but then loses the second leg (the subsequent game), then the player would win 3:1 (using paytable 1) or 3:1 (using paytable 2). If the player places the bonus parlay wager and wins a bonus win (first leg) and wins the second leg with a pair (both cards are of identical rank) then the player would win 5:1 (using paytable 1) or 5:1 (using paytable 2), (note that if the player has a pair he would not qualify for the bonus round). If the player places the bonus parlay wager and wins a bonus win and then makes a regular win on the second leg without a pair (which means the player does not win the bonus round) then the player wins 10:1 (paytable 1) or 10:1 (paytable 2). If the player places the bonus parlay wager and gets a bonus win on the first leg and a bonus win on the second leg then the player wins 30:1 (paytable 1) or 25:1 (paytable 2).

Figure 4:
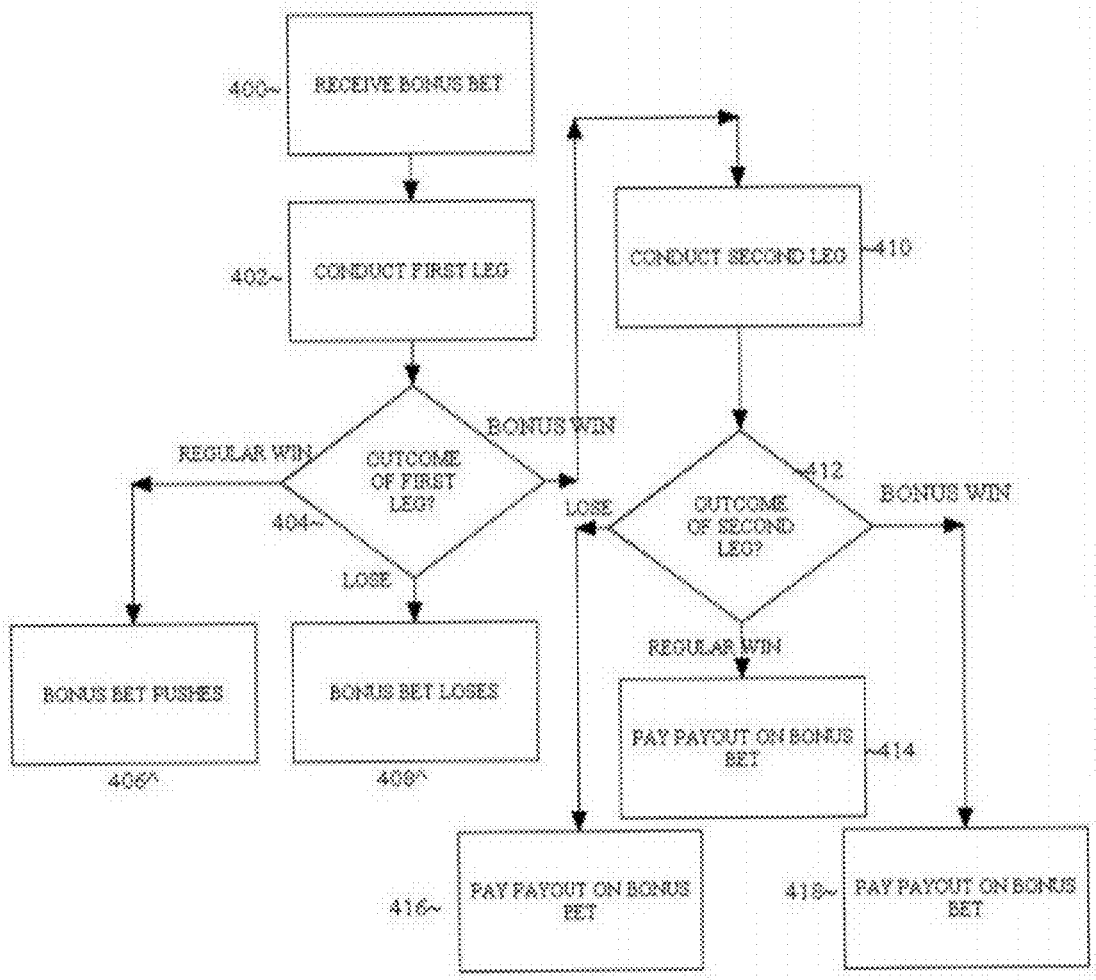
FIG. 4 is a flowchart illustrating an exemplary method of implementing a bonus parlay bet, according to an embodiment.

FIG. 4 is a flowchart illustrating an exemplary method of implementing a bonus parlay bet, according to an embodiment. FIG. 4 essentially implements the paytable illustrated in Table II, although of course other payout structures can be implemented as well.

The method can begin with operation 400, which receives a bonus parlay wager from the player. This can be done during operation 100 of FIG. 1.

From operation 400, the method proceeds to operation 402, which conducts a first leg (plays one round of the game). Thus, operations 100-210 can be carried out (FIGS. 1 and 2) as described herein.

From operation 402, the method proceeds to operation 404, which evaluates the outcome of the first leg (first game). If the player lose the first game, then the method proceeds to operation 408, wherein the player loses the bonus parlay wager.

If in operation 404, the player had a regular win in the first game, then the method proceeds to operation 406, wherein the player's bonus parlay wager pushes.

If in operation 404, the player had a bonus win, then the method proceeds to operation 410, which conducts a second leg (second game). Aside from the bonus parlay wager carrying over, the outcomes of the first game should have no bearing on the second game. The player's bonus parlay wager (placed in operation 400) can now be moved to a different betting circle (typically by the dealer) so that it is documented that this is a bonus parlay wager carried over from the previous game. Bets that are carried over mean that the player must have received a bonus win on the first leg. The player is also free to make a new bonus parlay wager (thus the new bonus parlay wager will be on its first leg and the carried over bonus parlay wager will be on its second leg). The second game is carried out by performing operations 100-210 (FIGS. 1 and 2) again.

From operation 410, the method proceeds to operation 412, which evaluates the outcome of the second leg (second game). If the player lost the second game, then the method proceeds to operation 416, which pays a particular payout for this situation on the bonus parlay wager (e.g., 3:1).

If in operation 412, the player received a regular win on the second leg, then the method proceeds to operation 414, which pays a particular payout for this situation. Different payouts can also be made. For example, if the player achieved his or her regular win on the second leg with a pair (the final two cards are a pair (operation 104 results in "yes"), then a particular payout can be made (e.g., 5:1). If the player achieved his or her regular win on the second leg but did not have a pair, then a particular payout can be made (e.g., 10:1) although other payouts can be used).

If in operation 412, the player achieved a bonus win in the second game, then the method proceeds to operation 418, which a highest payout on the bonus parlay wager (e.g., 25:1, 30:1, or other amount).

Figure 5:
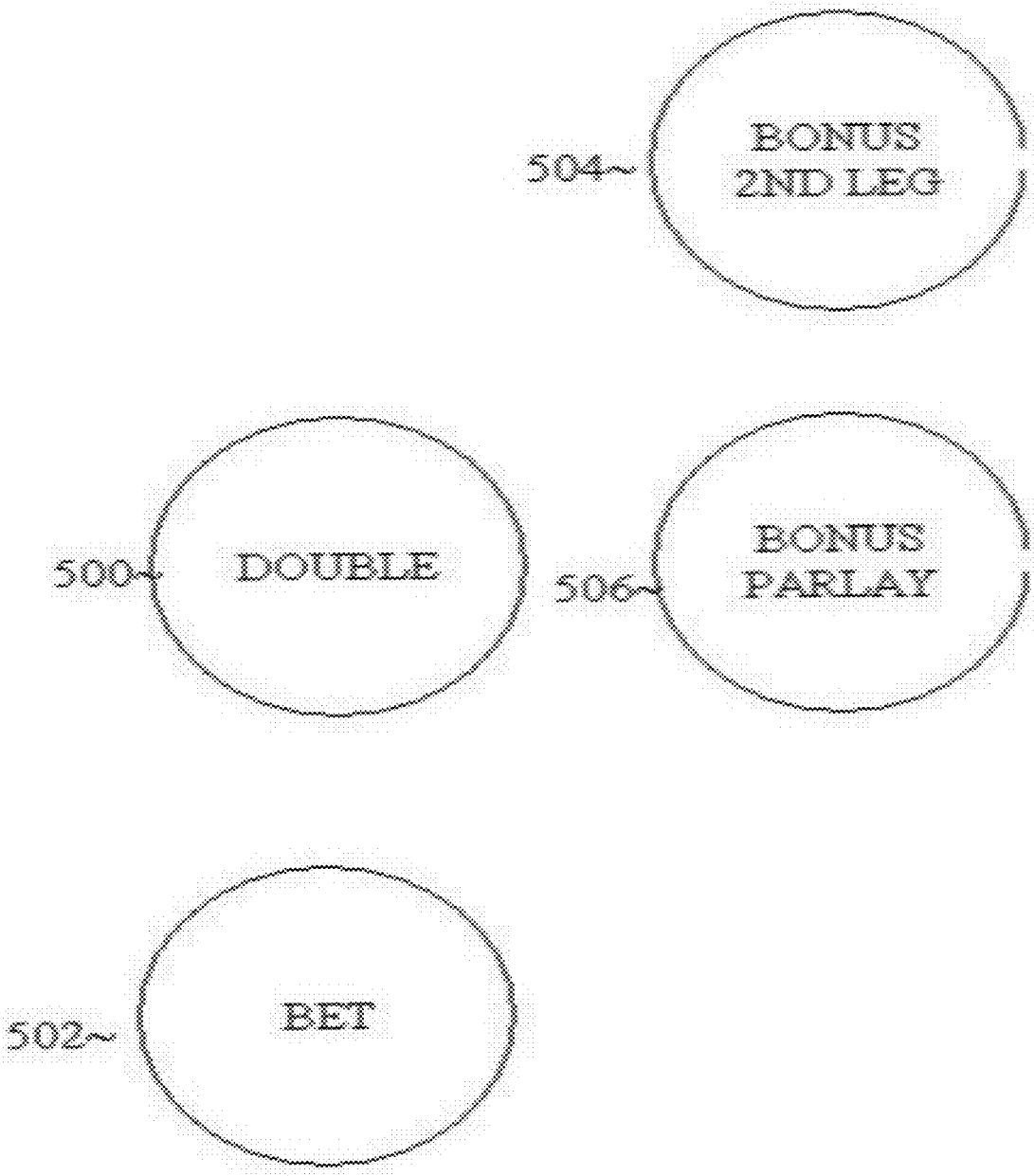
FIG. 5 is a drawing illustrating a betting layout for a player that implements a bonus parlay wager, according to an embodiment.

FIG. 5 is a drawing illustrating a betting layout for a player that implements a bonus parlay wager, according to an embodiment.

An initial wager betting circle 502 and a double betting circle 500 correspond to those illustrated in FIGS. 3A-3F. A bonus betting circle 506 is for the initial (first leg) bonus parlay wager, and a bonus $2^{nd}$ leg betting circle 504 is for the second leg. The player would place his or her bonus parlay wager in the bonus betting circle 506, but the player would not be allowed to directly place new wagers into the bonus $2^{nd}$ leg betting circle 504. If a player places a bonus parlay wager in bonus betting circle 506 and the player loses that bet (by losing the first leg game), then the bet is taken by the dealer (house). If the player gets a bonus win on the first leg, then any bonus parlay wagers on the bonus betting circle 506 would be moved (typically by the dealer) to the bonus $2^{nd}$ leg betting circle 504 so that the second leg of the game can be played. The player is of course free to place a brand new bonus parlay wager on the bonus betting circle 506. The next game will be the first leg for any bet on the bonus betting circle 506 and will be the second leg for any bet on the bonus $2^{nd}$ leg betting circle 504.

Figure 6:
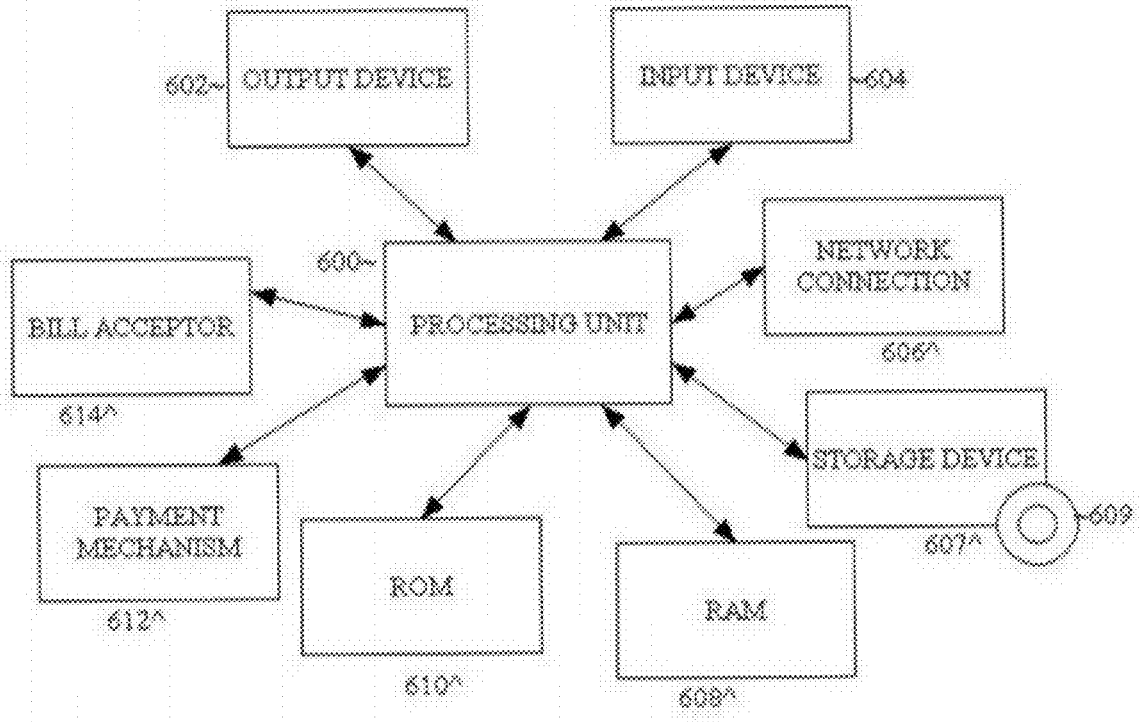
FIG. 6 is a block diagram of hardware that can be used to implement an electronic version of the invention, according to an embodiment.

FIG. 6 is a block diagram of hardware that can be used to implement an electronic version of the invention, according to an embodiment.

A processing unit 600 (such as a microprocessor and associated apparatus such as bus, cache, etc.) can be connected to an output device 602 (such as an LCD screen, touch-screen, speaker, etc.) and an input device 604 (such as a touch-screen, keyboard, mouse, buttons, etc.) The processing unit 600 can also be connected to a network connection 606 (such as an LAN, WAN, wifi, Internet, etc.) The processing unit 600 can also be connected to a RAM 608 and a ROM 610 and a bill acceptor 614 (which can also accept cashless vouchers or funds via electronic deposit). The processing unit 600 can also be connected to a payment mechanism 612 which can make payment to the player of any winnings (either in physical coins, cash, cashless ticket, or electronic funds transfer). Funds can be deposited (via bill acceptor 614) which can then be converted to playable credits which is used by the player to make his or her wagers. When the player desires to cash out the playable credits, the credits can then be converted to a cash amount which his then issued via the payment mechanism 612.

The processing unit 600 can also be connected to a storage device 607 (e.g., hard disk, CD-ROM, DVD-drive, BLU-RAY, EPROM, etc.) which can read an appropriate computer readable storage medium 609 (such as a CD-ROM, etc.) that stores a program that controls the processing unit 600 to implement the methods described herein.

Also not pictures is a player tracking apparatus that can be used to track player's play at a physical gaming table. The gaming table contains a magnetic (or other encoding) card reader that can read a player's players card. When a player sits down to play at a table, the dealer can swipe the player's card through electronic card reader, which information about the player's identify is thereafter transmitted to a casino electronic database so that the player's wagering activity can be tracked. Thus, when the player places higher wagers in the methods described herein, these wagers can be tracked in the electronic database (using the player's identification ascertained from the electronic card reader at the table).

Any embodiments described herein can be played with a standard deck of cards or any type of special deck (e.g. a Spanish deck, etc.) The game can also be played with a single deck or multiple decks (e.g. 1-8 decks or more). Cards can be dealt in any order. Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement a wagering game, the method comprising:

executing computer readable instructions on an electronic processor that perform the following operations:

receiving a first initial wager and a bonus parlay wager from a player;

conducting a first wagering game using virtual deck(s) of cards to a first result, the first result being from a set of possible outcomes comprising non-bonus win which wins without triggering a bonus round, loss, and bonus win which wins and also triggers a bonus round, the bonus round comprising dealing an additional card and providing the player an opportunity to win an additional award;

resolving the first initial wager;

conducting a second wagering game to resolve a second initial wager received from the player using the deck(s) of cards to a second result, the second result being from a set of possible outcomes comprising non-bonus win which wins without triggering a bonus round, loss, and bonus win which wins and also triggers a bonus round, the bonus round comprising dealing an additional card and providing the player an opportunity to win an additional award;

resolving the second initial wager; and resolving the bonus parlay wager based upon a set of predetermined conditions, wherein the set of predetermined conditions comprises if the player loses the first initial wager then the player loses the bonus parlay wager;

wherein the set of predetermined conditions comprises if the player receives a bonus win on the first wagering game and a bonus win on the second wagering game then the bonus parlay wager wins a first payout;

wherein the set of predetermined conditions comprises if the player receives a bonus win on the first wagering game and does not achieve a bonus win on the second wagering game, then the bonus parlay wager wins a second payout, the second payout being lower than the first payout.

2. The method as recited in claim 1, wherein if the player receives a bonus win on the first wagering game and a non-bonus win on the second wagering game, then performing:

if a set of two cards dealt during the second wagering game is a pair then the second payout is lower than if the set of two cards is not a pair.

3. The method as recited in claim 1, wherein if the player wins the first wagering game then the bonus parlay wager is moved to a different betting circle before the second wagering game is commenced.

4. The method as recited in claim 1, wherein if the player achieves a non-bonus win on the first wagering game then the bonus parlay wager is pushed.

5. An electronic gaming apparatus to implement a wagering game, the apparatus comprising:

an input device;

an output device;

a processing unit configured to execute instructions causing a computer to perform:

receiving a first initial wager and a bonus parlay wager from a player;

conducting a first wagering game using deck(s) of cards to a first result, the first result being from a set of possible outcomes comprising non-bonus win which wins without triggering a bonus round, loss, and bonus win which wins and also triggers a bonus round, the bonus round comprising dealing an additional card and providing the player an opportunity to win an additional award;

resolving the first initial wager;

conducting a second wagering game to resolve a second initial wager received from the player using the deck(s) of cards to a second result, the second result being from a set of possible outcomes comprising non-bonus win which wins without triggering a bonus round, loss, and bonus win which wins and also triggers a bonus round, the bonus round comprising dealing an additional card and providing the player an opportunity to win an additional award;

resolving the second initial wager; and resolving the bonus parlay wager based upon a set of predetermined conditions, wherein the set of predetermined conditions comprises if the player loses the first initial wager then the player loses the bonus parlay wager;

wherein the set of predetermined conditions comprises if the player receives a bonus win on the first wagering game and a bonus win on the second wagering game then the bonus parlay wager wins a first payout;

wherein the set of predetermined conditions comprises if the player receives a bonus win on the first wagering game and does not achieve a bonus win on the second wagering game, then the bonus parlay wager wins a second payout, the second payout being lower than the first payout.

6. An electronic gaming apparatus to implement a wagering game, the apparatus comprising:

an input device;

an output device;

a processing unit configured to execute instructions causing a computer to perform:

receiving a first initial wager and a bonus parlay wager from a player;

conducting a first wagering game using deck(s) of cards to a first result, the first result being from a set of possible outcomes comprising non-bonus win, loss, and bonus win;

resolving the first initial wager;

receiving a second initial wager from the player;

conducting a second wagering game using the deck(s) of cards to a second result, the second result being from a set of possible outcomes comprising non-bonus win, loss, and bonus win;

resolving the second initial wager; and resolving the bonus parlay wager based upon a set of predetermined conditions, wherein the set of predetermined conditions comprises if the player loses the first initial wager then the player loses the bonus parlay wager;

wherein the set of predetermined conditions comprises if the player receives a bonus win on the first wagering game and a bonus win on the second wagering game then the bonus parlay wager wins a first payout;

wherein the set of predetermined conditions comprises if the player receives a bonus win on the first wagering game and does not achieve a bonus win on the second wagering game, then the bonus parlay wager wins a second payout, the second payout being lower than the first payout, wherein if the player receives a bonus win on the first wagering game and a non-bonus win on the second wagering game, then performing:

if a set of two cards dealt during the second wagering game is a pair then the second payout is lower than if the set of two cards is not a pair.

7. The apparatus as recited in claim 5, wherein if the player wins the first wagering game then the bonus parlay wager is moved to a different betting circle before the second wagering game is commenced.

8. The apparatus as recited in claim 5, wherein if the player achieves a non-bonus win on the first wagering game then the bonus parlay wager is pushed.

* * * * *